US005853861A

United States Patent [19]

Held

[11] Patent Number: 5,853,861

[45] Date of Patent: Dec. 29, 1998

[54] INK JET PRINTING OF TEXTILES

[75] Inventor: Robert Paul Held, Newark, Del.

[73] Assignee: E. I. du Pont de Nemours and Company, Wilmington, Del.

[21] Appl. No.: 941,808

[22] Filed: Sep. 30, 1997

[51] Int. Cl.[6] ..... B32B 7/10; B32B 27/06; B32B 37/34

[52] U.S. Cl. ..... 428/207; 428/476.1; 428/483; 428/477.7; 428/500; 428/507; 428/913; 8/541

[58] Field of Search ..... 428/195, 207, 428/411.1, 475.1, 47.8, 477.7, 500, 507, 480, 483, 913; 8/541

[56] References Cited

U.S. PATENT DOCUMENTS 5,085,698 2/1992 Ma et al. ..... 106/20
5,429,860 7/1995 Held et al. ..... 428/195
5,537,137 7/1996 Held et al. ..... 347/105

FOREIGN PATENT DOCUMENTS 409143472 6/1997 Japan .

*Primary Examiner*—Margaret Einsmann
*Attorney, Agent, or Firm*—Joseph A. Tessari

[57] ABSTRACT

An ink/textile combination is provided wherein the ink contains an aqueous carrier, a pigment and a polymer having acid, base, epoxy or hydroxy functional moieties and the textile contains hydroxyl, amine, amido or carboxyl groups and either an organometallic crosslinking agent or an isocyanate crosslinking agent, and wherein upon exposure of the printed image to an external energy source, the crosslinking agent will react with the textile and the polymer in the ink to produce images having improved durability, waterfastness and wash-fastness.

10 Claims, No Drawings

INK JET PRINTING OF TEXTILES

BACKGROUND OF THE INVENTION

This invention relates to an ink and fabric set in ink jet printing, and more particularly, to an ink/fabric combination that produces more durable, water-fast and wash-fast images.

Dyeing of fibrous articles with anionic dyes, particularly articles containing polyamide fibers is known. Anionic dyes such as acid dyes and pre-metallized dyes are widely used for the dyeing of polyamide fibers in which the nitrogen containing groups of the polyamide fibers such as Nylon® and hydroxy groups of the cellulose fibers such as cotton, rayon etc. serve as the dye sites.

Conventionally, the dyeing of fiber containing articles involves immersion of the article in an aqueous bath containing a solution of the dye after the article has been pretreated by treatments well-known in the art. Typically all the dye used in the process is added to the bath prior to immersion of the article; that is, the bath is at "full strength" prior to immersion of the article. The bath is then typically raised to an elevated temperature, often as high as the boiling point at ordinary atmospheric pressure. At times, dyeing is done at extreme temperatures using autoclaves.

In an alternate process, disclosed in U.S. Pat. No. 5,230,709, the bath containing the article is first raised to a temperature characterized as a "transition temperature" for the particular polyamide. The dye solution is then introduced to the bath in aliquots in such a way that the polyamide fibers are kept "hungry" for dye.

The above processes are used for uniform dyeing of the article. For dyeing articles to produce a pattern, it is known use a screen printing process for the application of the dye.

Dyes which are used in the processes know in the art are often called small molecule "leveling" dyes. Where good light fastness and/or wash fastness are required, large molecule and premetallized dyes are more desirable. Yet, these types of dyes have the disadvantage in that they are structure sensitive, meaning that minor variation in the physical structure of the fibers are revealed in the final dyed product. This is undesirable. It is known to use dye auxiliaries and retarding agents to counteract this defect, but the use of such compounds often inhibit the ability of the fibers to be deeply colored or have dark shades.

Another approach to dyeing polyamides and mixed fiber articles, such as polyamides and cotton, makes use of fiber reactive dyes. Such reactive dyes form covalent bonds with free amine end groups of the polyamide fraction and covalent bonds with the hydroxyl groups of the cellulosic fraction. One class of reactive dyes are the dichloro-s-triazinyl system. These dyes in aqueous solution can be displaced from solution onto the polyamide by addition of salt (e.g., potassium chloride) and then alkali which fixes the dye with the fiber. Another class are the vinyl sulfone reactive dyes based upon sulfate esters of hydroxysulphonyl dyes. Under alkaline conditions the vinyl sulfone group is generated which in turn reacts with ionized cellulose to form the covalent bond between dye and fiber. As disclosed in U.S. Pat. No. 4,762,524; dyeing of polyamides at the boil with vinyl sulfone reactive dyes is also possible under conditions therein disclosed. As a result, it is know to dye polyamide and cotton blends with appropriately chosen fiber reactive dye systems. In particular, better wash fastness and color fastness for deep shades are obtainable with fiber reactive dyes. However, this process is disadvantageous in that it includes wet processing and the proper disposal of the effluent stream containing unreacted dye adds expense and raises environmental concerns.

Attempts have been made recently to reproduce high quality colored pictorial information using ink jet technologies for applications such as textile printing. Ink jet printing is a non-impact method for recording information in response to an electronic signal, such as that generated by a computer. In the printer, the electronic signal produces droplets of ink that are deposited on a substrate or media such as paper or transparent film. Such attempts have been met with several challenges. For example, it has proved difficult to accurately reproducing the various hues, tints, and colors contained in a typical colored picture on fabric articles using ink jet printers. In addition, the images printed on such articles are expected to be durable (crock-fast), water-fast and wash-fast.

The processes described above for processing of textile fabric or fibers have several processing limitations and the dyes have their own limitations when it is desired to record a high quality, multicolored image. Color selection is limited because many of the readily available dyes lack color fastness (i.e., the dye tends to fade upon exposure to ultraviolet light) or do not have enough solubility to give the required chroma. Moreover, the tendency of ink droplets to wick or bleed together is an aggravated problem because the printing of a high quality image depends on the formation of small, sharply defined dots of each printed color. While some of the problems associated with dye based inks can be overcome or alleviated to some extent, a need still exists for better inks and/or better treatments or coatings for fabrics or fibers that will be ink jet printed. A specific need exists for such an ink/fabric combination that is capable of reproducing colored pictorial information as a high quality, durable, wash-fast and water-fast image on fabric substrates, thereby meeting the requirements for textile printing.

SUMMARY OF THE INVENTION

The present invention provides an ink jet ink/textile combination comprising:

a) an ink jet ink containing an aqueous carrier medium, a pigment and a polymer, wherein the polymer has functional moieties selected from the group consisting of acid, base, epoxy and hydroxy moieties; and b) a textile containing moieties selected from the group consisting of hydroxyl, amine, amido, carboxyl moieties and mixtures thereof, said textile further containing a cross-linking compound selected from the group consisting of:

i) an organometallic compound represented by the general formula:

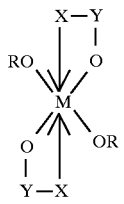

wherein

X is a functional group containing oxygen or nitrogen, e.g., ketone, ester, acid salt, etc.;

Y is alkyl of 1 to 6 carbon atoms or arylalkyl wherein aryl is 6 to 10 carbon atoms and alkyl is 1 to 6 carbon atoms;

M is Ti, Al, Zn or Zr; and

R is hydrogen, alkyl of 1 to 6 carbon atoms, or hydroxy substituted alkyl of 1 to 6 carbon atoms;

ii) an organometallic compound represented by the general formula:

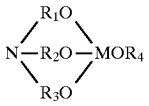

wherein $R_1$, $R_2$ or $R_3$ can be the same or different, and are alkyl of 1 to 4 carbon atoms;

$R_4$ is alkyl of 1 to 6 carbon atoms;

M is Ti, Al, Zn or Zr; and iii) an isocyanate having the general formula:

$$R—(CNO)_a$$

wherein

R is a hydrocarbon, aromatic hydrocarbon, aliphatic aromatic hydrocarbon, etc.

a is 1 or 2;

wherein upon exposure to an external energy source, the crosslinking compound reacts with the textile and the polymer in the ink.

The ink/textile combination has general utility in printing, particularly in ink-jet printing applications using thermal or bubble jet printers, piezoelectric printers, continuous flow printers, air brush printers or valve jet printers.

DETAILED DESCRIPTION OF THE INVENTION

The present invention provides an ink jet ink/textile combination which provides printed images having improved durability (crock fastness), wash-fastness and water-fastness, on both imaged and non-imaged areas of the textile. The essential components of the combination are an ink jet ink and a textile.

Ink Jet Ink

The ink jet ink comprises an aqueous carrier medium, a pigment, and a polymer having functional moieties selected from the group consisting of acid, base, epoxy and hydroxy moieties which will react with the crosslinking compound under prescribed conditions. The ink also may contain other additives known in the art.

Aqueous Carrier Medium

The aqueous carrier medium is water or a mixture of water and at least one water-soluble organic solvent. Selection of a suitable mixture depends on requirements of the specific application, such as desired surface tension and viscosity, the selected colorant, drying time of the ink, and the type of substrate onto which the ink will be printed. Representative examples of water-soluble organic solvents that may be selected are disclosed in U.S. Pat. No. 5,085,698. A mixture of water and a polyhydric alcohol, such as diethylene glycol, is preferred as the aqueous carrier medium.

If a mixture of water and a water-soluble solvent is used, the aqueous carrier medium typically will contain 30% to about 95% water with the balance (i.e., 70 to 5%) being the water-soluble solvent. Preferred compositions contain approximately 60% to 95% water, based on the total weight of the aqueous carrier medium.

The amount of aqueous carrier medium in the ink is in the range of approximately 70 to 99.8%, preferably 80 to 99.8%, based on total weight of the ink when an organic pigment is selected and approximately 25 to 99.8%, preferably 70 to 99.8% when an inorganic pigment is selected.

Pigment

Pigments, as the term is understood in the art and used herein, means a colorant that remains in a particulate or crystalline state (i.e., insoluble) throughout the printing process. Either organic or inorganic pigments may be selected, alone or in combination. The pigment particles are sufficiently small to permit free flow of the ink through the ink jet printing device, especially at the ejecting nozzles that usually have a diameter ranging from 10–50 microns. The particle size also has an influence on the pigment dispersion stability, which is critical throughout the life of the ink. Brownian motion of minute particles will help prevent the particles from settling. It is also desirable to use small particles for maximum color strength. The range of useful particle size is approximately 0.005 micron to 15 microns. Preferably, the pigment particle size should range from 0.005 to 5 microns and most preferably, from 0.01 to 0.3 microns. Representative commercial dry and presscake pigments that may be used to advantage are disclosed in U.S. Pat. No. 5,085,698.

Fine particles of metal or metal oxides also may be used as the pigment in the practice the invention. For example, metal and metal oxides are suitable for the preparation of magnetic ink jet inks. Fine particle size oxides, such as silica, alumina, titania, and the like, also may be selected. Furthermore, finely divided metal particles, such as copper, iron, steel, aluminum and alloys, may be selected for appropriate applications.

Improved durability, wash-fastness and water-fastness of the image may be achieved using organic pigments having the same functional moieties as the polymer which will react with the crosslinking agent; i.e., acid, base, epoxy, and hydroxy moieties.

When an organic pigment is selected, the ink may contain up to approximately 30% pigment by weight, but typically will be in the range of 0.1 to 15% (preferably 0.1 to 8%) by weight for most thermal ink jet printing applications. If an inorganic pigment is selected, the ink will tend to contain higher weight percentages of pigment than with comparable inks employing organic pigment, and may be as high as approximately 75% in some cases, because inorganic pigments generally have higher specific gravity than organic pigments.

Polymer

The polymer required to be present in the ink can function either as a dispersant for the pigment or may function as an ink additive, e.g., a binder. Either structured or random polymers may be used, although structured polymers are preferred for use as dispersants for reasons well known in the art. The term "structured polymer" as used in the art and herein, means polymers having a block, branched or graft structure. The polymer contains functional moieties selected from the group consisting of acid, base, epoxy and hydroxy moieties which are capable of reacting with the crosslinking agent in the textile.

Particularly preferred structured polymers are AB or BAB block copolymers disclosed in U.S. Pat. No. 5,085,698; ABC block copolymers disclosed in European Patent Application 0 556 649 A1, published Aug. 28, 1993 which is equivalent to U.S. Pat. No. 5,519,085; and graft polymers disclosed in U.S. Pat. No. 5,231,131. The disclosure of each of these references is incorporated herein by reference.

Polymers dispersants suitable for use in the present invention comprise both hydrophobic and hydrophilic monomers. Some examples of hydrophobic monomers used in random polymers are methyl methacrylate, n-butyl methacrylate, 2-ethylhexyl methacrylate, benzyl methacrylate, 2-phenylethyl methacrylate and the corresponding acrylates. Examples of hydrophilic monomers are methacrylic acid, acrylic acid, dimethylaminoethyl [meth]acrylate and salts thereof. Also quaternary salts of dimethylaminoethyl [meth] acrylate may be employed.

The number average molecular weight of the polymer must be less than 10,000 Daltons, and is preferably less than 6,000 and most preferably less than 3,000. High molecular weight species of polymer can plug the nozzles in the ink jet print head, especially thermal ink jet print heads, and therefore are to be avoided. Polymers having a polydispersity (the relationship between number average molecular weight and weight average molecular weight) between 1–3, most preferably between 1–2 are most advantageous.

Polymeric additives can be employed in lieu of or in addition to the dispersant mentioned above. The types of polymers that may be used as additives include linear polymers, emulsion polymers (e.g., core/shell emulsion polymers), emulsion polymers stabilized by structured polymers, hydrosols, etc.

Other Ingredients

The ink jet ink may contain other ingredients as are well known in the art. For example, anionic, nonionic, or amphoteric surfactants may be used. In aqueous inks, the surfactants may be present in the amount of 0.01–5% and preferably 0.2–2%, based on the total weight of the ink. Cosolvents may be included to improve penetration and pluggage inhibition properties of the ink composition, such as those exemplified in U.S. Pat. No. 5,272,201. Biocides may be used to inhibit growth of microorganisms. Dowicides® (Dow Chemical, Midland, Mich.), Nuosept® (Huls America, Inc., Piscataway, N.J.), Omidines® (Olin Corp., Cheshire, Conn.), Nopcocides® (Henkel Corp., Ambler, Pa.), Troysans® (Troy Chemical Corp., Newark, N.J.) and sodium benzoate are examples of such biocides. Sequestering agents such as EDTA may also be included to eliminate deleterious effects of heavy metal impurities. Other known additives may also be added to improve various properties of the ink compositions as desired.

Ink Properties

Jet velocity, separation length of the droplets, drop size and stream stability are greatly affected by the surface tension and the viscosity of the ink. Pigmented ink jet inks suitable for use with ink jet printing systems should have a surface tension in the range of about 20 dyne/cm to about 70 dyne/cm and, more preferably, in the range 30 dyne/cm to about 70 dyne/cm at 20° C. Acceptable viscosity is no greater than 20 cP, and preferably in the range of about 1.0 cP to about 10.0 cP at 20° C. The ink has physical properties compatible with a wide range of ejecting conditions, i.e., driving voltage and pulse width for thermal ink jet printing devices, driving frequency of the piezo element for either a drop-on-demand device or a continuous device, and the shape and size of the nozzle. The inks have excellent storage stability for a long period and do not clog in an ink jet apparatus. Further, the ink does not corrode parts of the ink jet printing device it comes in contact with, and it is essentially odorless and non-toxic.

Textile

Textiles useful in this invention include those containing hydroxy, amine, amido or carboxyl groups, protein-like fibers, polypropylene, polyacrylonitrile, cellulose triacetate and mixtures thereof.

Some examples of hydroxyl group containing textiles include, but are not limited to, cellulose containing fibers such as viscose staple and cotton and fibers containing fibrion hydroxy polymers. Suitable amine or amido group containing fibers include wool, synthetic polyamides and silk. Polyamide fibers include, but are not limited to, those spun from diamine-diacid polymers: nylon 6,6; nylon 6,12; nylon 6,10; and nylon 4,6. Fibers spun from polymers derived from cyclic lactam monomers or omega-aminocarboxylic acids: nylon 6, nylon 7, nylon 11, nylon 12; and fibers spun from copolyamides of notably nylon 6,6 or nylon 6 are also included. Some examples of carboxy group containing textile include, but are not limited to, polyester fibers such as those based on polybutylene terephthalate, poly-1,4-cyclohexylene dimethylene terephthalate, but in particular polyethylene terephthalate, which may have been modified, for example, with the view to easier printability, by co-condensing them with other components such as other dicarboxylic acids and other diols.

The finished form of the textile used to practice this invention includes, but is not limited to, fibers, yarns, fabrics, non-woven webs and garments, as well as, furnishings like carpets and upholstery fabrics.

Crosslinking Agent

In accordance with the invention, the textile contains a crosslinking agent, which is either an organometallic compound (e.g., titanates, zirconates, etc.) or an isocyanate. The function of the crosslinking agent is to react with the textile and the polymer contained in the ink and thereby improve the durability, wash-fastness and water-fastness of the printed image. An external energy source, such as heat, may be needed to effect the cross-inking reaction. Preferably, the crosslinking agent may be introduced into or onto the textile by application from a solution. This allows for uniform application at fairly low solution concentrations.

Organometallic crosslinking compounds useful for this invention have the general structure:

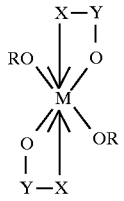

wherein

X is a functional group containing oxygen or nitrogen, e.g., ketone, ester, acid salt, etc.;

Y is alkyl of 1 to 6 carbon atoms or arylalkyl wherein aryl is 6 to 10 carbon atoms and alkyl is 1 to 6 carbon atoms;

M is Ti, Al, Zn or Zr; and

R is hydrogen, alkyl of 1 to 6 carbon atoms, or hydroxy substituted alkyl of 1 to 6 carbon atoms.

Another group of organometallic crosslinking compounds useful in the invention have the general formula

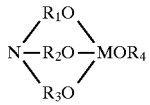

wherein $R_1$, $R_2$ or $R_3$ can be the same or different, and are alkyl of 1 to 4 carbon atoms, and $R_4$ is alkyl of 1 to 6 carbon atoms, and M is Ti, Al, Zn or Zr.

Suitable isocyanate crosslinking compounds have the general formula $R—(CNO)_a$ wherein R is a hydrocarbon, aromatic hydrocarbon, aliphatic aromatic hydrocarbon, etc. and a is 1 or 2.

Suitable titanium crosslinking agents are known in the art and may be prepared as described in Smeltz, U.S. Pat. No. 4,609,479. Preferred organic titanates include lactic acid titanium chelate, ammonium salt and some preferred organic zirconates are available from DuPont under the tradename Tyzor® as Tyzor® 212, Tyzor® 217, etc. Some useful isocyanates include TMX DI (meta) aliphatic isocyanate available from Cytec Industries as CAS # 2778-42-9.

Applications

The ink is applied to the textile using conventional techniques such as thermal or bubble jet printers, piezoelectric printers, continuous flow printers, air brush or valve jet printers. After the ink is printed on the textile, the printed textile is air dried. The crosslinking reaction can then be effected by exposing the printed textile to an external energy source, such as heat.

EXAMPLES

The invention will now be further illustrated, but not limited, by the following examples.

The following terms are used in the examples and have the following meanings:

MACADOL=N-methylolmethacrylamide
EHA=ethylhexylmethacrylate
STY=styrene
MMA=methylmethacrylate
MAA=methacrylic acid
HEA=hydroxyethylacrylate
TMXDI=p-(alpha,alpha,alpha',alpha'-tetramethyl-alpha, alpha'-diisocyanato)xylene
BZMA=benzylmethacrylate
BMA=butylmethacrylate Dispersant 1

BMA/MMA//MAA (10/5//10) Block Copolymer

A 12-liter flask was equipped with a mechanical stirrer, thermometer, $N_2$ inlet, drying tube outlet, and addition funnels. Tetrahydrofuran THF, 3027 gm, and p-xylene, 6.2 gm, were charged to the flask. The catalyst, tetrabutyl ammonium m-chlorobenzoate (2.5 ml of a 1.0M solution in acetonitrile) was then added. Initiator, 1,1-bis (trimethylsiloxy)-2-methyl propene, 234.4 gm (1.01M) was injected. Feed I (tetrabutyl ammonium m-chlorobenzoate, 2.5 ml of a 1.0M solution in acetonitrile) was started and added over 150 minutes. Feed II (trimethylsilyl methacrylate, 1580 gm (10.0M)) was started at 0.0 minutes and added over 30 minutes. One hundred and twenty minutes after Feed II was completed (over 99% of the monomers had reacted), Feed III (butyl methacrylate, 1425 gm (10.0M), and methyl methacrylate, 503 gm (5.0M)) was started and added over 30 minutes.

At 320 minutes, 650 gm of dry methanol were added to the above solution and distillation was begun. During the first stage of distillation, 1250.0 gm of material were removed from the flask, 1182 gm of I-propanol was added. Distillation continued and a total of 2792 gm of solvent were removed. This made a butyl methacrylate/methyl methacrylate//methacrylic acid AB block polymer (BMA/MMA//MAA 10/15//10) having a number average molecular weight of 2900 and 50.5% solids.

Dispersant 2

MAA//BzMA//ETEGMA (13//10//4) ABC Block Copolymer

To a solution of 9.05 g (10.5 mL, 51.9 mmol) of 1-methoxy-1-trimethylsiloxy-2-methyl-1-propene and 2 mL of tetrabutylammonium biacetate (0.1M in propylene carbonate) in 150 mL of THF was added dropwise 107 g (121 mL, 0.677 mole) of trimethylsilyl methacrylate. During the course of the addition, the temperature of the reaction mixture rose slowly and an additional 2 mL portion of tetrabutylammonium biacetate (0.1M in propylene carbonate) was added. The temperature continued to rise to 57° C. after all of the monomer had been added. When the temperature fell to 33° C., the addition of a mixture of 91.6 g (88.6 mL, 0.52 mole) of benzyl methacrylate (purified by passage over a column of basic alumina under argon) was begun. An additional 1 mL of tetrabutylammonium biacetate (0.1M in propylene carbonate) was added when the temperature leveled off at 39° C. As the addition of monomer was complete, the temperature rose to 57° C. When the temperature had decreased to 35° C., 51.2 g (51.2 mL, 0.205 mole) of ethoxytriethylene glycol methacrylate (purified by passage over a column of basic alumina under argon) was added dropwise from an addition funnel, and the mixture was stirred overnight. Analysis of an aliquot of the solution by $^1H$ NMR showed that there was no residual monomer present.

The solution of poly(trimethylsilyl methacrylate [48 mol %]-b-benzyl methacrylate [37 mol %]-b-ethoxy-triethylene glycol methacrylate [15 mol %]) was refluxed for 12 hr with 150 mL of 0.03M methanolic tetrabutyl-ammonium fluoride and an additional 100 mL of THF. After evaporation in a rotary evaporator under reduced pressure, the residual polymer was dried for 48 hr in a vacuum oven at 50° C. to give 186.3 g of poly(methacrylic acid [48 mol %]-b-benzyl methacrylate [37 mol %]-b-ethoxy-triethylene glycol methacrylate [15 mol %]). $^1H$ NMR analysis of the product showed that no trimethylsilyl ester groups remained.

The ABC block polymer was neutralized with potassium hydroxide by mixing 20 g of the polymer with 7 g of potassium hydroxide (45.6% solution in deionized water) and 173 g of deionized water until a homogeneous 10% polymer solution was obtained.

Dispersant 3

BzMA//MAA 13//10 AB Block Copolymer

A 12-liter flask was equipped with a mechanical stirrer, thermometer, $N_2$ inlet, drying tube outlet, and addition funnels. Tetrahydrofuran THF, 3750 gm, and p-xylene, 7.4 gm, were charged to the flask. The catalyst tetrabutyl ammonium m-chlorobenzoate, 3.0 ml of a 1.0M solution in acetonitrile, was then added. Initiator, 1,1-bis (trimethylsiloxy)-2-methyl propene, 291.1 gm (1.25M) was injected. Feed I [tetrabutyl ammonium m-chlorobenzoate, 3.0 ml of a 1.0M solution in acetonitrile] was started and added over 180 minutes. Feed II [trimethylsilyl methacrylate, 1975 gm (12.5M)] was started at 0.0 minutes and added over 35 minutes. One hundred minutes after Feed II was completed (over 99% of the monomers had reacted) Feed III [benzyl methacrylate, 2860 gm (16.3M) was started and added over 30 minutes.

At 400 minutes, 720 gm of methanol were added to the above solution and distillation begun. During the first stage of distillation, 1764.0 gm of material were removed. Then more methanol 304.0 gm was added and an additional 2255.0 gm of material were distilled out. It was at 49.7% solids.

The polymer has a composition of BZMA//MAA 13//10. It has a molecular weight of Mn=3,200.

Binder 1

MMA/STY/2EHA/HEA/MAA/MACADOL (67/17/6/4/4/2)

1,331 g of Rhodaponal® L-22, (Rhone-Poulenc, Princeton, N.J.) and 951 g of Polystep® B-1 40 (Stepan Company, Northfield, Ill.), were added to 1635 g of deionized water in a mixing kettle. The temperature was set at 190° F. (87.8° C.) and the following ingredients was added, without stirring, to the water/surfactant mixture in the kettle.

| INGREDIENT | AMOUNT (g) |
|---|---|
| Rhodaponal ® L-22 | 3802.0 |
| Polystep ® B-1 | 2661.0 |
| HEA | 9125.0 |
| MAA | 9125.0 |
| 60% MACADOL | 13653.0 |
| STY | 45624.0 |
| EHA | 150404.0 |
| Deionized water | 10000.0 |

79,842 g of MMA and 166,413 g of deionized water were then added and the temperature was adjusted to 80°–85° F. (26°–29° C.) and the mixture was agitated for 45 minutes.

This pre-emulsified mixture was placed in an addition funnel attached to a reaction vessel equipped with an air stirrer, nitrogen inlet and a heating mantle. It was added over a period of 100 minutes with the temperature maintained at a 188°–193° F. (86.8°–89.4° C.) for 60 minutes. After that the reaction vessel was cooled to 148°–152° F. (64.°–66.7° C.).

The following mixture was added to the reaction vessel after 5% of the pre-emulsified mixture was added and followed immediately by the addition of 10,000 g of deionized water.

| INGREDIENT | AMOUNT (g) |
|---|---|
| Ammonium persulfate (dissolved) | 760.0 |
| Deionized water | 32,640.0 |

The pH was adjusted to 9.0 and 42,175 g of deionized water were added. The mixture was held at 148°–152° F. (64.4°–66.7° C.) for 120 minutes, then cooled and filtered. This gives an emulsion polymer at 35.7% solids.

Binder 2

22.5 grams of Dispersant 1 were added to 82 grams of deionized water and 4.13 grams of 45% KOH and stirred until dissolved.

Binder 3

22.5 grams of Dispersant 2 were added to 82 grams of deionized water and 4.13 grams of 45% KOH and stirred until dissolved.

Binder 4

22.5 grams of polymer from Dispersant 3 were added to 82 grams of deionized water and 4.13 grams of 45% KOH and stirred until dissolved.

Magenta Dispersion 1

A magenta pigment dispersion was prepared by mixing together 272 grams of Dispersant 1; 408 grams of PR-122 pigment (Quindo Magenta 122, BASF), and 66 grams of diethylene glycol. The mixture was then charged to a two roll mill (Model XJF-S2637 Adalet Manufacturing Co., Cleveland Ohio) and processed for 45 minutes. The temperature of one roll was held at 150° C. and the other roll was approximately 10° C. cooler. This made a pigment dispersion that contained 55% pigment, 36.46% polymer and 8.9% diethylene glycol. 1176.4 grams of the dispersion was then neutralized with 140 grams of 45% KOH and diluted with 2683.6 grams of deionized water with stirring, resulting a pigment concentrate contained 15% pigment.

Magenta Dispersion 2

Magenta Dispersion 1 was repeated except that Dispersant 2 was used in place of Dispersant 1.

Magenta Dispersion 3

Magenta Dispersion 1 was repeated except that Dispersant 3 was used in place of Dispersant 1.

Magenta Dispersion 4

Magenta Dispersion 1 was repeated except that PR-123 (Perylene Red (Scarlet) 123, BASF) was used in place of PR-122.

Magenta Dispersion 5

Magenta Dispersion 4 was repeated except that Dispersant 2 was used in place of Dispersant 1.

Magenta Dispersion 5

Magenta Dispersion 4 was repeated except that Dispersant 3 was used in place of Dispersant 1.

Example 1

Textile

100% cotton fabric was soaked for 5 minutes in a 5 wt. % solution of lactic acid titanate chelate, ammonium salt. The fabric was then air dried.

Ink

A magenta ink was prepared having the following composition:

| Ingredient | Amount (wt. %) |
|---|---|
| Magenta Dispersion 1 | 22.9 |
| Magenta Dispersion 2 | 3.2 |
| Binder 1 | 20.0 |
| Diethylene glycol | 5.3 |
| Liponics ® EG-1 | 5.7 |
| N-methylpyrollidone | 0.9 |
| Deionized water | 42.0 |

An ink image was printed on the textile using an HP DeskJet® 550C ink jet printer (Hewlett Packard, Palo Alto, Calif.). After printing, the fabric and printed image were subjected to 290° F. (143.3° C.) for 5 minutes. The sample was then subjected to water rinsing and soap washing. The image was unaffected.

Example 2

Example 1 was repeated using a textile comprising a 50–50% cotton/polyester blend. The image was unaffected by rinsing and washing.

Example 3

Examples 1 and 2 were repeated using an ink with the following composition:

| Ingredient | Amount (wt. %) |
|---|---|
| Magenta Dispersion 2 | 22.9 |
| Magenta Dispersion 5 | 3.2 |
| Diethylene glycol | 0.4 |
| Liponics ® EG-1 | 5.7 |
| 2-pyrollidone | 3.1 |
| N-methylpyrollidone | 2.0 |

-continued

| Ingredient | Amount (wt. %) |
|---|---|
| Binder 2 | 20.0 |
| Deionized water | 42.0 |

The images on both printed fabrics were unaffected by rinsing and washing.

Example 4

Examples 1 and 2 were repeated using an ink with the following composition:

| Ingredient | Amount (wt. %) |
|---|---|
| Magenta Dispersion 3 | 22.9 |
| Magenta Dispersion 6 | 3.2 |
| Diethylene glycol | 0.4 |
| Liponics ® EG-1 | 5.7 |
| 2-pyrollidone | 3.1 |
| N-methylpyrollidone | 2.0 |
| Binder 3 | 20.0 |
| Deionized water | 42.0 |

The images on both printed fabrics were unaffected by rinsing and washing.

Example 5

Example 1 was repeated using a textile comprising 100% Supplex® nylon. The printed image was water-fast, but did not withstand washing with soap. The results indicate that the crosslinking agent reacted with the polymer(s) in the ink but did not react with the fibers in the textile.

Example 6

Textile

Supplex® nylon fabric was soaked in a 5% solution of TMXDI in toluene for 5 minutes and then air dried.

Ink

Magenta inks having the following composition were prepared:

| Ingredient | Amount (wt. %) A | Amount (wt. %) B |
|---|---|---|
| Magenta Dispersion 1 | 22.9 | 22.9 |
| Magenta Dispersion 4 | 3.2 | 1.28 |
| Binder | 0.32 | 1.28 |
| Diethylene glycol | 5.50 | 5.50 |
| Liponics ® EG-1 | 5.00 | 5.00 |
| Deionized water | 63.08 | 62.12 |

An ink image was printed on the textile fabric with an HP DeskJet® 500C printer and the image was heated to 100° F. (37.8° C.) for 2 minutes. The sample was then subjected to water rinsing and soap washing. The image was unaffected, indicating that the isocyanate crosslinking agent reacted with the textile fibers and the polymer(s) in the ink.

What is claimed is:

1. An ink jet ink/textile combination comprising:

a) an ink jet ink containing an aqueous carrier medium, a pigment and a polymer, wherein the polymer has functional moieties selected from the group consisting of acid, base, epoxy and hydroxy moieties; and b) a textile containing moieties selected from the group consisting of hydroxyl, amine, amido, carboxyl moieties and mixtures thereof, said textile having been treated with a solution consisting of a cross-linking compound selected from the group consisting of:

i) an organometallic compound represented by the general formula:

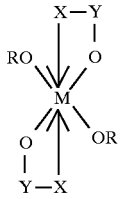

wherein

X is a functional group containing oxygen or nitrogen, e.g., ketone, ester, acid salt, etc.;

Y is alkyl of 1 to 6 carbon atoms or arylalkyl wherein aryl is 6 to 10 carbon atoms and alkyl is 1 to 6 carbon atoms;

M is Ti, Al, Zn or Zr; and

R is hydrogen, alkyl of 1 to 6 carbon atoms, or hydroxy substituted alkyl of 1 to 6 carbon atoms;

ii) an organometallic compound represented by the general formula:

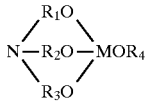

wherein $R_1$, $R_2$ or $R_3$ can be the same or different, and are alkyl of 1 to 4 carbon atoms;

$R_4$ is alkyl of 1 to 6 carbon atoms;

M is Ti, Al, Zn or Zr; and iii) an isocyanate having the general formula:

$$R—(CNO)_a$$

wherein

R is a hydrocarbon, aromatic hydrocarbon, aliphatic aromatic hydrocarbon, etc.

a is 1 or 2;

wherein upon exposure to an external energy source, the crosslinking compound reacts with the textile and the polymer in the ink.

2. The ink/textile combination of claim 1 wherein the textile contains fibers selected from the group consisting of cellulose, fibrion hydroxy polymers, polyamide, polyesters, protein-like fibers and mixtures thereof.

3. The ink/textile combination of claim 1 wherein textile is selected from the group consisting of wool, synthetic polyamide, viscose staple, cotton, polyester and silk.

4. The ink/textile combination of claim 1 wherein the crosslinking agent is lactic acid titanium chelate, ammonium salt.

5. The ink/textile combination of claim 1 wherein the crosslinking agent is p-(alpha, alpha, alpha', alpha'-tetramethyl-alpha, alpha'-diisocyanato)xylene.

6. The ink/textile combination of claim 1 wherein the polymer is a dispersant for the pigment.

7. The ink/textile combination of claim 1 wherein the polymer is a structured polymer selected from the group consisting of block polymers, graft polymers and branched polymers.

8. The ink/textile combination of claim 7 wherein the structured polymer is an AB, BAB, or ABC block copolymer.

9. The ink/textile combination of claim 7 wherein the structured polymer is a graft polymer.

10. The ink/textile combination of claim 1 wherein the aqueous carrier medium is a mixture of water and a water soluble organic solvent.

* * * * *